United States Patent [19]

Dunipace

[11] Patent Number: 4,568,297

[45] Date of Patent: Feb. 4, 1986

[54] FLYING DISC

[75] Inventor: David B. Dunipace, Temecula, Calif.

[73] Assignee: Champion Discs, Incorporated, San Marino, Calif.

[21] Appl. No.: 545,850

[22] Filed: Oct. 27, 1983

[51] Int. Cl.[4] ..... A63H 27/00

[52] U.S. Cl. ..... 446/46

[58] Field of Search ..... 446/46, 47, 48; 273/424, 425

[56] References Cited

U.S. PATENT DOCUMENTS

| | | | |
|---|---|---|---|
| 3,710,505 | 1/1973 | Linenfelser | 273/424 X |
| 3,758,985 | 9/1973 | Heisler | 273/424 X |
| 4,204,357 | 5/1980 | Harrington | 446/46 |
| 4,334,385 | 6/1982 | Melin et al. | 446/46 |

FOREIGN PATENT DOCUMENTS

| | | | |
|---|---|---|---|
| 181801 | 4/1955 | Austria | 273/424 |

*Primary Examiner*—Mickey Yu

*Attorney, Agent, or Firm*—Harris, Kern, Wallen & Tinsley

[57] ABSTRACT

A one-piece flying disc formed of a flexible plastic with an annular rim and a central section joined together by an annular shoulder. The rim has a lower edge defining a lower plane of the disc and the central section has an upper zone defining an upper plane of the disc, with the rim having a triangular cross-section with a lower rounded corner forming the lower edge, an outer rounded corner, and an upper corner merging with the shoulder. The outer corner of the rim is located between the upper and lower planes, and the shoulder decreases in thickness from the rim to the central section.

4 Claims, 3 Drawing Figures

FLYING DISC

BACKGROUND OF THE INVENTION

This invention relates to the now widely used circular flying disc, and in particular to a new and improved flying disc formed in a single molding operation and having superior performance characteristics.

The basic flying disc design is in the order of nine inches diameter, with a thin flat center section of substantially uniform thickness, and a thick substantially cylindrical rim. There is a small curved transition at the periphery of the center section where it joins the rim.

Previous attempts to refine and improve the flying disc have been concentrated in two main areas; ballistics and gimmicks. Although various claims have been made, little actual improvement in the aerodynamic properties of the flying disc has been achieved over the basic design.

The ballistics area has been generally more fruitful as far as improvement of performance is concerned. These improvements include heavier plastics with filler material, thinner profile, and smaller diameter. These changes do increase disc performance by improving the ballistic rather than true flight character of the disc.

The gimmick area is lead by the addition of flight rings but also includes such things as double flight plates, finger holds, holes and grooves to channel air flow, and various multiple piece designs. A considerable number of patents have issued in this area, but these variations do little if anything to improve disc performance.

Disc performance can be divided into three main areas: flight characteristic, ability to fly, and throwability. Flight characteristic is the flight path the disc takes when thrown correctly. A stable or nearly stable flight path is generally considered to be the most desirable, and the disc of the present invention retains this desirable characteristic. All of the best performing discs on the market today fly in an essentially stable configuration. Ability to fly includes lift, drag, and ballistic properties, and is judged in various wind conditions. To achieve flight under windy conditions previous designs have increased the ballistic efficiency of their disc. This has basically resulted in smaller and more dense flying discs which require more effort to throw and have more potential to injure both the thrower and anyone who might be hit with this missle. The new design of the present invention takes a different tack by increasing the actual flight efficiency by reducing drag, increasing the lifting area and redistributing mass toward the rim. This obviates the need for heavy mass while improving flight performance.

Throwability or ease of putting the disc into flight is another area where the design of the present invention provides an improvement. Generally the smaller diameter discs require a higher rate of spin to remain in stable flight. Smaller discs are easier to handle if not easier to throw correctly. Because these two factors conflict a compromise has been in existing designs. If ease of throwing is desired a larger diameter disc is utilized. If performance is desired a small diameter disc is chosen. The new design disclosed herein changes the mass distribution toward and into the rim thereby reducing the spin necessary to achieve a stable flight and making a small diameter disc just as easy to throw as a large diameter with no loss of performance. In addition, the triangular shape of the rim allows for easier gripping both for the novice and experienced player, and is an additional factor contributing to the throwability of the disc.

Previous disc designs have employed a generally uniform flight plate thickness and were only concerned with whether or not it would hold its shape while not adding too much weight to the disc. The new design has incorporated the flight plate into the aerodynamics and mass distribution effect of the disc. The flight plate is progressively thinner toward the center of the disc starting from the rim, and disc flexing increases as the thickness decreases for maximum flexing in the center of the disc.

The effect of this feature is threefold: (1) the thumb of the thrower is on top of the disc and can be pushed into the flight plate and around the back side of the rim for easier gripping, (2) the disc will be safer upon impact (as with a person) because the center section will buckle and absorb much of the impact energy, and (3) the center will tend to dome upward as it is thrown faster because of centrifugal force and air flow dynamics.

This last effect increases stability at high speeds. Discs generally tend to turn over when thrown faster, and the new design compensates by changing aerodynamic configuration as the speed at which it is thrown changes.

Accordingly, it is an object of the present invention to provide a new and improved flying disc formed in a single piece and closely resembling the basic flying disc and retaining the true flight capabilities of the basic disc, while providing aerodynamic shape and mass distribution of the disc.

It is an object of the invention to provide a new and improved flying disc with high rim mass for more gyroscopic and stabilizing force, and providing the center of mass between the upper and lower planes of the disc for stable flight configuration in various wind conditions. A further object of the invention is to provide such a flying disc with a triangular rim configuration with an outward rounded corner providing lower aerodynamic resistance and smooth air flow. An additional object is to provide such a flying disc which achieves the desired performance characteristics without requiring high density plastic materials, and permitting the disc to be made of a relatively flexible plastic.

Other objects, advantages, features and results will more fully appear in the course of the following description.

SUMMARY OF THE INVENTION

A circular flying disc having an annular rim and a central section joined together by an annular shoulder, and formed in a single piece of flexible plastic. The rim has a lower edge defining a lower plane of the disc, and the central section has an upper zone defining an upper plane of the disc. The rim has a triangular cross-section with a lower rounded corner forming the lower edge of the disc, an outer rounded corner, and an upper corner merging with the shoulder. The outer corner of the rim is located between the upper and lower planes. The shoulder decreases in thickness from the rim to the central section, and the outer surface of the disc from the rim outer corner to the central section has a continuous smooth curved lifting surface.

In the preferred embodiment, the rim cross-section is substantially an equilateral triangle, the thickness of the shoulder at the rim is in the order of twice the thickness of the central section, and the upper surface of the central section is substantially flat when the disc is stationary while being sufficiently thin and flexible to dome upwards when in flight.

DESCRIPTION OF THE PREFERRED EMBODIMENT

Figure 1:
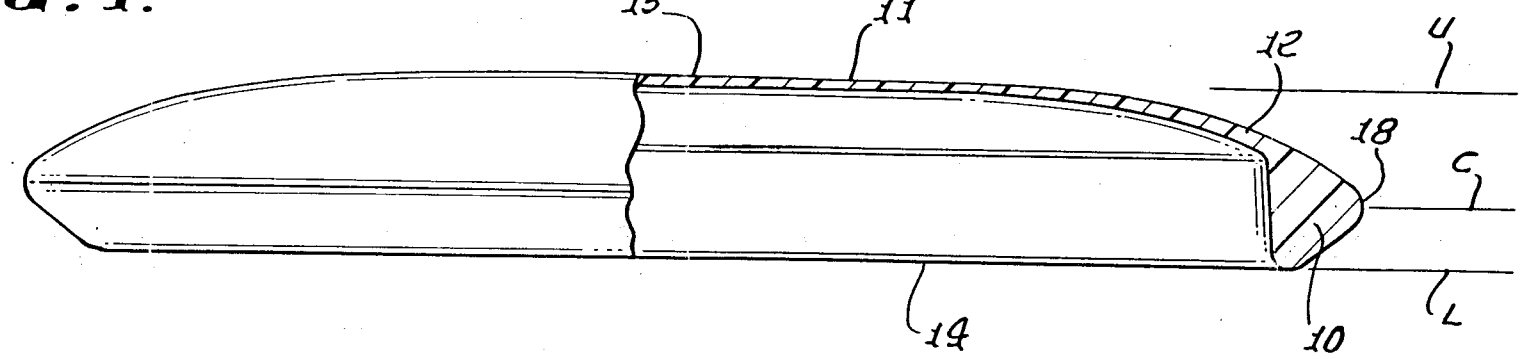
FIG. 1 is a side view, partly in section, of a flying disc incorporating the presently preferred embodiment of the invention.

The flying disc as shown in the drawings includes an annular rim 10, a central section 11, and an annular shoulder 12. The disc is circular in shape and of uniform annular cross-section. The disc is a single piece structure and typically is molded of a relatively flexible plastic. The central section and the annular shoulder form the flight plate.

The rim 10 has a lower edge 14 which defines a lower plane of the disc, and the central section 11 has an upper zone 15 which defines an upper plane of the disc. The lower and upper planes are indicated by the lines L and U, respectively.

Figure 2:
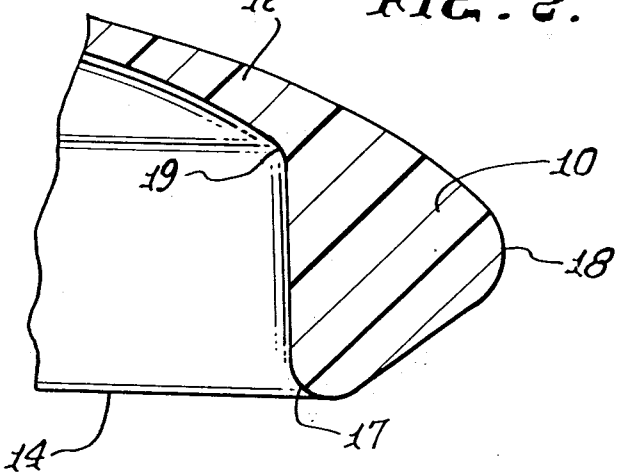
FIG. 2 is an enlarged partial sectional view of the rim of the disc of FIG. 1.

The rim 10 is triangular in cross-section, and preferably is substantially equilateral, as best seen in FIG. 2. The rim has a lower rounded corner 17, an outer rounded corner 18, and an upper corner 19 which merges into the shoulder 12. The location of the outer corner 18 is indicated by the line C in FIG. 1, and is between the upper and lower planes U, L. In the preferred embodiment, the outer corner 18 is in the midrange between the upper and lower planes, and preferably is spaced upward from the lower plane L in the order of one-third the distance between the planes U, L.

The annular shoulder 12 which joins the rim 10 to the central section 11 decreases in thickness from the rim toward the central section, and preferably has the thickness of the shoulder at the rim in the order of twice the thickness of the central section.

The outer surface of the disc from the rim outer corner 18 to the central section 11 is a continuous smooth curve which provides the desired lifting surface for flight of the disc. The central section 11 preferably is substantially flat when the disc is stationary, as shown in FIG. 1. However being relatively thin and flexible, this central section will dome upwards when in flight providing improved lift and stability when thrown at higher speeds.

Figure 3:
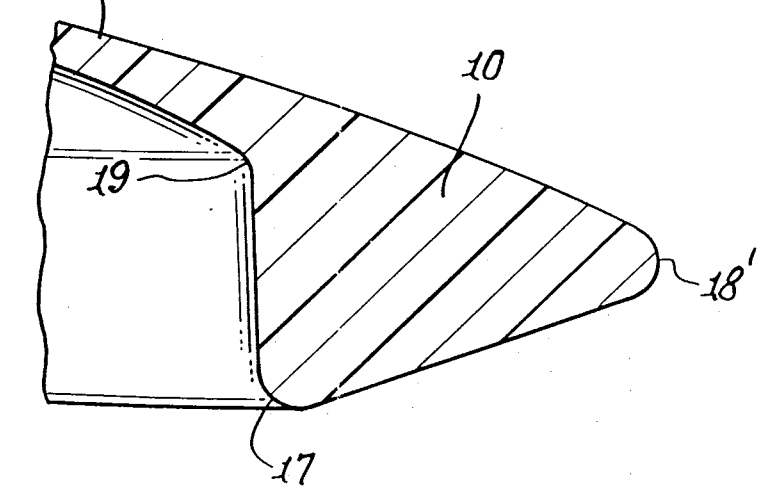
FIG. 3 is a view similar to that of FIG. 2 showing an alternative embodiment of the invention.

An alternative shape for the rim 10 is shown in FIG. 3, wherein the triangular cross-section is substantially isosceles with the shorter side between the corners 17 and 19, and with the longer sides between the corners 17, 18' and 19, 18', and with the height of the isosceles triangle as measured from the base 17, 19, in the order of twice the corresponding height of the equilateral triangle of FIG. 2.

The triangular rim configuration provides a reduced aerodynamic drag, while at the same time providing increased weight at the rim and improved gyroscopic stability. The outer point of the triangular rim needs to be between the upper and lower planes of the disc, and a continuous smooth curve from the outer corner to the central section is desirable for improved lifting. With the heavy triangular rim and the thin flexible central section, the flat central section domes upward in high speed flight providing improved stability and increased lift The location of the outer point of the rim is fairly critical in the design of the disc of the present invention. If the point is much less than one-third of the distance upward from the plane L to the plane U, an increase in lift is obtained but the resulting lower center of mass tends to destabilize the disc. Conversely, if the rim point is much above the midpoint between L and U, stability is improved but there is a decrease in lift which adversely affects performance.

With these new design features, the disc of the present invention provides improved performance, particularly in range and in stability.

Flying discs are made of lower density material (less than 1.0) and of higher density material (greater than 1.0), and discs especially designed for disc golf may use a material of a density as high as 2.0. The design of the disc of the present invention is suitable for use with both the lower density materials and the higher density materials, and provides improved characteristics with both.

The molding plastics currently in use for flying discs are suitable for use with the disc of the invention. The preferred embodiment is made with a material having a relatively high flexibility, typically a 56,500 PSI flexual modulus as compared to a 219,00 PSI flexual modulus for currently used plastics.

The stability of a flying disc is its resistance to turning over in flight as a result of poor launching, cross winds, change in speed, and the like, and observations of the flying disc of the present invention show that it is more stable when thrown under such adverse conditions than the basic disc. At the same time an increase in range in the order of 15 to 25% is achieved.

I claim:

1. A circular flying disc comprising an annular rim and a central section joined together by an annular shoulder, and formed in a single piece of flexible plastic, said rim having a lower edge defining a lower plane of said disc, and said central section having an upper zone defining an upper plane of said disc, said rim having a substantially equilateral triangular cross-section with a lower rounded corner forming said lower edge, an outer rounded corner, and an upper corner merging with said shoulder, with said outer corner located between said upper and lower planes, said shoulder decreasing in thickness from said rim to said central section, with the thickness of said shoulder at said rim in the order of twice the thickness of said central section, and with the outer surface of said disc from said rim outer corner to said central section having a continuous smooth curved lifting surface, and the upper surface of said central section being substantially flat when the disc is stationery, with said central section being sufficiently thin and flexible to dome upwards when in flight.

2. A flying disc as defined in claim 1 wherein said outer corner of said rim is in the midrange between said upper and lower planes.

3. A flying disc as defined in claim 1 wherein said outer corner of said rim is spaced upward from said lower plane in the order of one-third the distance between said planes.

4. A flying disc as defined in claim 1 wherein said lower corner and said outer corner of said rim cross-section are joined by a substantially straight line.

* * * * *